US007441596B2

(12) United States Patent
Wood et al.

(10) Patent No.: US 7,441,596 B2
(45) Date of Patent: Oct. 28, 2008

(54) SWELLING ELEMENT PACKER AND INSTALLATION METHOD

(75) Inventors: Edward T. Wood, Kingwood, TX (US); Steven N. Bailey, College Station, TX (US); Walter J. Laflin, Houston, TX (US); Vel Berzin, Houston, TX (US); James R. Korte, Katy, TX (US); Edward J. O'Malley, Houston, TX (US); Bennett M. Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/473,740

(22) Filed: Jun. 23, 2006

(65) Prior Publication Data

US 2007/0295498 A1 Dec. 27, 2007

(51) Int. Cl.
*E21B 33/12* (2006.01)

(52) U.S. Cl. ..... 166/179; 166/387; 166/300; 277/331; 277/934

(58) Field of Classification Search ..... 166/118, 166/179, 187, 300, 387; 277/331, 332, 934
See application file for complete search history.

(56) References Cited

U.S. PATENT DOCUMENTS

| | | | | |
|---|---|---|---|---|
| 3,918,523 | A | 11/1975 | Stuber | |
| 4,137,970 | A | 2/1979 | Laflin et al. | |
| 4,612,985 | A | 9/1986 | Rubbo et al. | |
| 4,862,967 | A | 9/1989 | Harris | |
| 4,919,989 | A | 4/1990 | Colangelo | |
| 4,936,386 | A | 6/1990 | Colangelo | |
| 5,048,605 | A | 9/1991 | Toon et al. | |
| 5,195,583 | A * | 3/1993 | Toon et al. | 166/187 |
| 6,073,692 | A | 6/2000 | Wood et al. | |
| 6,286,603 | B1 * | 9/2001 | Parent | 166/387 |
| 6,834,725 | B2 | 12/2004 | Whanger et al. | |
| 6,848,505 | B2 | 2/2005 | Richard et al. | |
| 6,854,522 | B2 | 2/2005 | Brezinski et al. | |
| 2004/0020662 | A1 | 2/2004 | Freyer | |
| 2004/0055758 | A1 | 3/2004 | Brezinski | |
| 2004/0055760 | A1 | 3/2004 | Nguyen | |
| 2004/0118572 | A1 | 6/2004 | Whanger et al. | |

(Continued)

FOREIGN PATENT DOCUMENTS

GB 2396635 A 6/2004

(Continued)

OTHER PUBLICATIONS

Bettis Rubber Company, Bettis Hydraulic Installation Equipment; catalog p. 630; date unknown.

*Primary Examiner*—David J Bagnell
*Assistant Examiner*—Shane Bomar
(74) *Attorney, Agent, or Firm*—Steve Rosenblatt

(57) ABSTRACT

A sealing element that swells on exposure to well fluids present or added to the wellbore is assembled to the mandrel in a manner to induce circumferential stresses proximately to the inside diameter of the element so as to resist the tendency of the inside diameter of the element to grow during the swelling process. A vacuum and a pressure method are described. Leak paths between the mandrel and the sealing element are minimized or eliminated as a result.

17 Claims, 3 Drawing Sheets

U.S. PATENT DOCUMENTS

| | | | | |
|---|---|---|---|---|
| 2004/0123983 | A1 | 7/2004 | Cook | |
| 2004/0194971 | A1 | 10/2004 | Thomson | |
| 2004/0261990 | A1 | 12/2004 | Bosma et al. | |
| 2005/0067170 | A1 | 3/2005 | Richard | |
| 2005/0077052 | A1* | 4/2005 | Ohmer | 166/384 |
| 2005/0092363 | A1 | 5/2005 | Richard et al. | |
| 2005/0110217 | A1 | 5/2005 | Wood et al. | |
| 2005/0171248 | A1 | 8/2005 | Li et al. | |
| 2005/0199401 | A1* | 9/2005 | Patel et al. | 166/387 |
| 2006/0278391 | A1* | 12/2006 | Li et al. | 166/288 |
| 2007/0012444 | A1* | 1/2007 | Horgan et al. | 166/278 |
| 2007/0151724 | A1* | 7/2007 | Ohmer et al. | 166/187 |
| 2007/0158060 | A1* | 7/2007 | Baaijens et al. | 166/65.1 |

FOREIGN PATENT DOCUMENTS

| | | |
|---|---|---|
| JP | 04-363499 | 12/1992 |
| JP | 09-151686 | 6/1997 |
| JP | 2000-064764 | 2/2000 |
| WO | WO 2004/018836 A1 | 3/2004 |

* cited by examiner

SWELLING ELEMENT PACKER AND INSTALLATION METHOD

FIELD OF THE INVENTION

The field of this invention is packers whose elements swell downhole to create a seal and methods for installation of the swelling sealing element on the mandrel.

BACKGROUND OF THE INVENTION

Packers are used downhole to isolate portions of a wellbore from each other. There are many styles of packers. Some set by longitudinal compression of the sealing element by fluid pressure applied to a setting tool or by mechanical force such as from setting down weight. Other designs involve elements that are inflated. More recently, elements that swell to a sealing position on exposure to well fluids have been used. There have been many variations as outlined below.

Packers have been used that employ elements that respond to the surrounding well fluids and swell to form a seal. Many different materials have been disclosed as capable of having this feature and some designs have gone further to prevent swelling until the packer is close to the position where it will be set. These designs were still limited to the amount of swelling from the sealing element as far as the developed contact pressure against the surrounding tubular or wellbore. The amount of contact pressure is a factor in the ability to control the level of differential pressure. In some designs there were also issues of extrusion of the sealing element in a longitudinal direction as it swelled radially but no solutions were offered. A fairly comprehensive summation of the swelling packer art appears below:

I. References Showing a Removable Cover Over a Swelling Sleeve

1) Application U.S. 2004/0055760 A1

FIG. 2*a* shows a wrapping 110 over a swelling material 102. Paragraph 20 reveals the material 110 can be removed mechanically by cutting or chemically by dissolving or by using heat, time or stress or other ways known in the art. Barrier 110 is described in paragraph 21 as an isolation material until activation of the underlying material is desired. Mechanical expansion of the underlying pipe is also contemplated in a variety of techniques described in paragraph 24.

2) Application U.S. 2004/0194971 A1

This reference discusses in paragraph 49 the use of water or alkali soluble polymeric covering so that the actuating agent can contact the elastomeric material lying below for the purpose of delaying swelling. One way to accomplish the delay is to require injection into the well of the material that will remove the covering. The delay in swelling gives time to position the tubular where needed before it is expanded. Multiple bands of swelling material are illustrated with the uppermost and lowermost acting as extrusion barriers.

3) Application U.S. 2004/0118572 A1

In paragraph 37 of this reference it states that the protective layer 145 avoids premature swelling before the downhole destination is reached. The cover does not swell substantially when contacted by the activating agent but it is strong enough to resist tears or damage on delivery to the downhole location. When the downhole location is reached, pipe expansion breaks the covering 145 to expose swelling elastomers 140 to the activating agent. The protective layer can be Mylar or plastic.

4) U.S. Pat. No. 4,862,967

Here the packing element is an elastomer that is wrapped with an imperforate cover. The coating retards swelling until the packing element is actuated at which point the cover is "disrupted" and swelling of the underlying seal can begin in earnest, as reported in Column 7.

5) U.S. Pat. No. 6,854,522

This patent has many embodiments. The one in FIG. 26 is foam that is retained for run in and when the proper depth is reached expansion of the tubular breaks the retainer 272 to allow the foam to swell to its original dimension.

6) Application U.S. 2004/0020662 A1

A permeable outer layer 10 covers the swelling layer 12 and has a higher resistance to swelling than the core swelling layer 12. Specific material choices are given in paragraphs 17 and 19. What happens to the cover 10 during swelling is not made clear but it presumably tears and fragments of it remain in the vicinity of the swelling seal.

7) U.S. Pat. No. 3,918,523

The swelling element is covered in treated burlap to delay swelling until the desired wellbore location is reached. The coating then dissolves of the burlap allowing fluid to go through the burlap to get to the swelling element 24 which expands and bursts the cover 20, as reported in the top of Column 8)

8) U.S. Pat. No. 4,612,985

A seal stack to be inserted in a seal bore of a downhole tool is covered by a sleeve shearably mounted to a mandrel. The sleeve is stopped ahead of the seal bore as the seal first become unconstrained just as they are advanced into the seal bore.

II. References Showing a Swelling Material under an Impervious Sleeve

1) Application U.S. 2005/0110217

An inflatable packer is filled with material that swells when a swelling agent is introduced to it.

2) U.S. Pat. No. 6,073,692

A packer has a fluted mandrel and is covered by a sealing element. Hardening ingredients are kept apart from each other for run in. Thereafter, the mandrel is expanded to a circular cross section and the ingredients below the outer sleeve mix and harden. Swelling does not necessarily result.

3) U.S. Pat. No. 6,834,725

FIG. 3*b* shows a swelling component 230 under a sealing element 220 so that upon tubular expansion with swage 175 the plugs 210 are knocked off allowing activating fluid to reach the swelling material 230 under the cover of the sealing material 220.

4) U.S. Pat. No. 5,048,605

A water expandable material is wrapped in overlapping Kevlar sheets. Expansion from below partially unravels the Kevlar until it contacts the borehole wall.

5) U.S. Pat. No. 5,195,583

Clay is covered in rubber and a passage leading from the annular space allows well fluid behind the rubber to let the clay swell under the rubber.

6) Japan Application 07-334115.

Water is stored adjacent a swelling material and is allowed to intermingle with the swelling material under a sheath 16.

III. References Which Show an Exposed Sealing Element that Swells on Insertion

1) U.S. Pat. No. 6,848,505

An exposed rubber sleeve swells when introduced downhole. The tubing or casing can also be expanded with a swage.

2) PCT Application WO 2004/018836 A1

A porous sleeve over a perforated pipe swells when introduced to well fluids. The base pipe is expanded downhole.

3) U.S. Pat. No. 4,137,970

A swelling material 16 around a pipe is introduced into the wellbore and swells to seal the wellbore.

4) U.S. application Ser. No. 2004/0261990

Alternating exposed rings that respond to water or well fluids are provided for zone isolation regardless of whether the well is on production or is producing water.

5) Japan Application 03-166,459

A sandwich of slower swelling rings surrounds a faster swelling ring. The slower swelling ring swells in hours while the surrounding faster swelling rings do so in minutes.

6) Japan Application 10-235,996

Sequential swelling from rings below to rings above trapping water in between appears to be what happens from a hard to read literal English translation from Japanese.

7) U.S. Pat. Nos. 4,919,989 and 4,936,386

Bentonite clay rings are dropped downhole and swell to seal the annular space, in these two related patents.

8) U.S. application Ser. No. 2005/0092363 A1

Base pipe openings are plugged with a material that disintegrates under exposure to well fluids and temperatures and produces a product that removes filter cake from the screen.

9) U.S. Pat. No. 6,854,522

FIG. 10 of this patent has two materials that are allowed to mix because of tubular expansion between sealing elements that contain the combined chemicals until they set up.

10) U.S. application Ser. No. 2005/0067170 A1

Shape memory foam is configured small for a run in dimension and then run in and allowed to assume its former shape using a temperature stimulus.

Common to many of these designs is the concept that exposure to well or some other fluid will initiate the swelling process. What has been discovered as happening when the swelling commences is illustrated in FIGS. 1 and 2. FIG. 1 is the run in position and shows in section the mandrel 10 surrounded by the element 12 with a contact interface 14. This assembly is the result of sliding the sealing element 12 over the mandrel 10. Generally, the inside dimension of the element 12 is formed to allow it to slide over the mandrel 10 with little resistance for fast assembly. Optionally, some adhesive can be applied to the mandrel 10 or element 12. FIG. 2 illustrates one problem with an element slipped over a mandrel 10 upon swelling. The inside diameter 16 grows leaving a gap 18 to the mandrel 10. The presence of gap 18 is a leak path that can undermine the sealing grip of the packer. On the other hand, attempts at fixation of inside diameter 16 to mandrel 10 can still fail to stop the effect shown in FIG. 2 if the application of adhesive is spotty or inconsistent or well conditions cause loss of grip for a variety of reasons. On the other hand the presence of adhesive coupled with swelling can result in tearing of the element 12 or inhibiting the growth of the element 12 at the outer periphery 20.

In the past pipe end protectors were installed with hydraulic equipment using equipment from the Bettis Rubber Company.

The present invention addresses the tendency of swellable elements to pull away from the mandrel when exposed to fluids. Several assembly techniques are described which result in residual hoop stresses in the material after assembly. These forces resist internal diametric growth during the swelling process and help reduce the tendency of the element moving away from the mandrel when swelling begins. Other features of the invention are described below in the description of the preferred embodiment and the associated drawing with the claims setting out the full scope of the invention.

SUMMARY OF THE INVENTION

A sealing element that swells on exposure to well fluids present or added to the wellbore is assembled to the mandrel in a manner to induce circumferential stresses proximately to the inside diameter of the element so as to resist the tendency of the inside diameter of the element to grow during the swelling process. A vacuum and a pressure method are described. Leak paths between the mandrel and the sealing element are minimized or eliminated as a result.

DETAILED DESCRIPTION OF THE DRAWINGS

DETAILED DESCRIPTION OF THE PREFERRED EMBODIMENT

Figure 2:
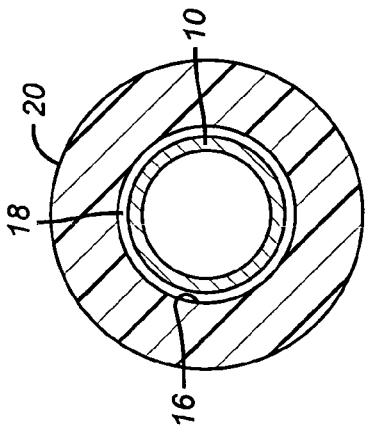
(PRIOR ART) FIG. 2
FIG. 2 is the view of FIG. 1 showing the inside diameter of the element pulling away after swelling.
Figure 1:
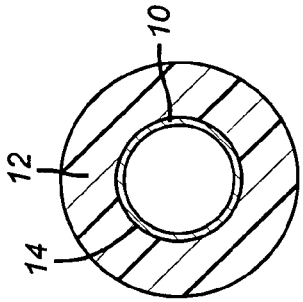
(PRIOR ART) FIG. 1
FIG. 1 is a run in section view of a prior art swelling element on a mandrel.
Figure 3:
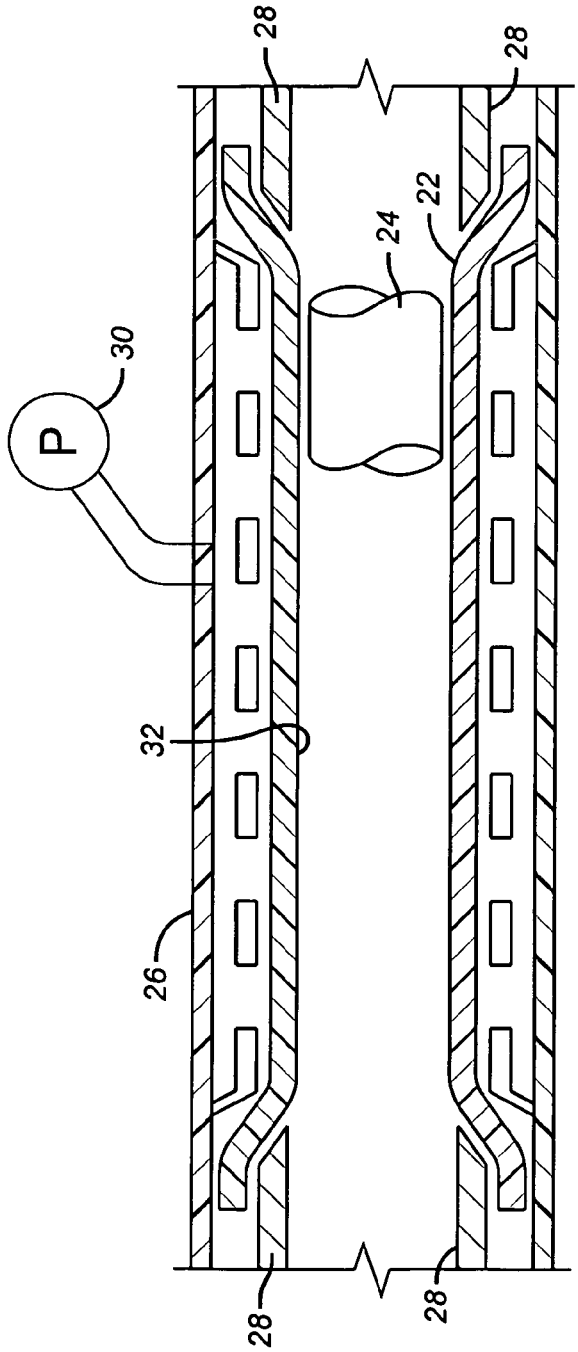
FIG. 3 illustrates a vacuum technique for mounting the swelling element to the mandrel to resist the pulling away from the mandrel tendency on swelling.

FIG. 3 is a schematic drawing of one way to get a swelling element 22 mounted on a mandrel 24 by securing it to slotted tube 26 and using retaining wedges 28 to seal off the ends. A vacuum source 30 is applied to the outside of the slotted tube 26 which reduces the inside diameter 32 of the element 22. With the vacuum applied the inside diameter 32 is larger than the outside diameter of the mandrel 24 to allow the mandrel 24 to be moved through the inside diameter 32. When the relative position between the element 22 and the mandrel 24 is achieved, the vacuum is removed and the inside diameter 32 grows until it makes intimate contact with the mandrel 24. The initial inside diameter 32 before a vacuum is pulled is preferably smaller than the outside diameter of the mandrel 24. After the vacuum is removed, the retaining wedges 28 can be removed and what is left is an element 22 that is stretched over the mandrel 24 leaving residual circumferential tensile forces in the element 22 that help retain it to the mandrel 24 for run in and after swelling. Adhesives in the interface between the mandrel 24 and the element 22 are not necessary. The net result of this assembly technique is that the element is subjected to hoop stresses that tend to make its inside dimension stay put against the mandrel 24 surface to which it is mounted to minimize, if not eliminate, a leak path between them.

Figure 4:
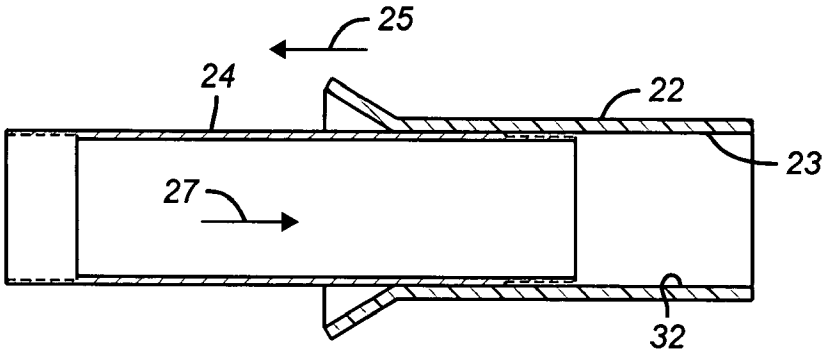
FIG. 4 illustrates a pressure technique for mounting a swelling sleeve on blank pipe.
Figure 5:
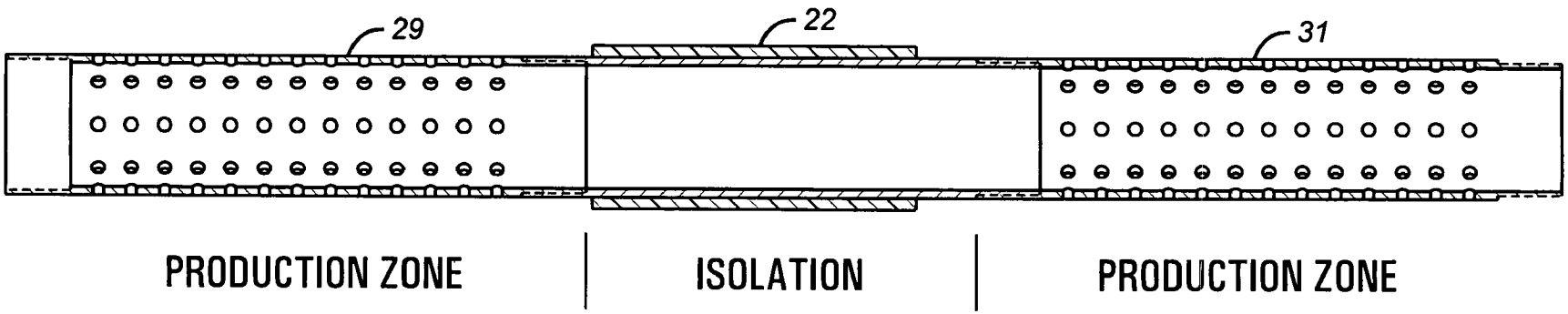
FIG. 5 shows the addition of a swelling sleeve between screen sections for eventual isolation using a pressure technique.
Figure 6:
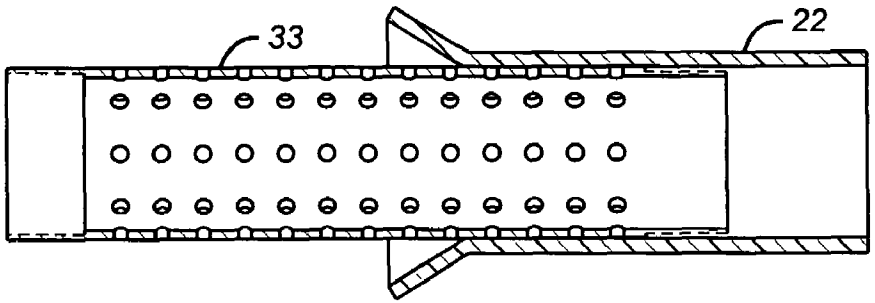
FIG. 6 shows the use of a pressure technique to cover a portion of a screen as needed by anticipated well conditions and again using the pressure technique.
Figure 7:
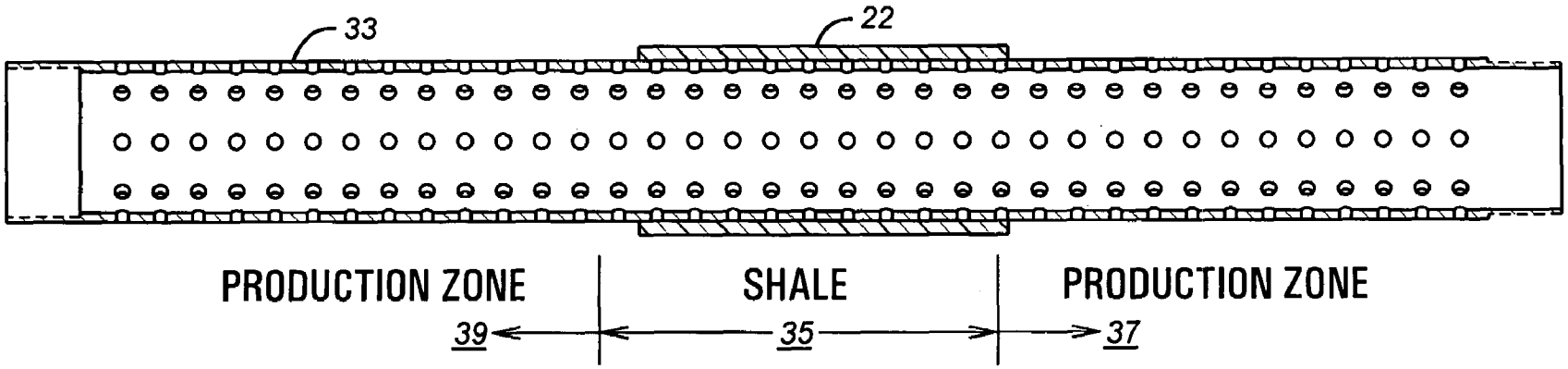
FIG. 7 shows a swelling sleeve on a portion of a screen that is to be covered to avoid surrounding well conditions from affecting the function of the screen above or below.

The mounting technique can be varied to get the same result. For example, instead of pulling an initial vacuum as illustrated in FIG. 3 the element 22 can be internally pressurized, shown schematically by arrow 23 in FIG. 4, to increase its inside diameter 32 as a mandrel 24 is then slipped through the inside diameter 32 that is increased in dimension due to the pressurization from within. The arrows 25 and 27 indicate that either on or both mandrel 24 and element 22 can move in the assembly process. In this alternative way, the result of creating residual hoop stresses in the element 22 are accomplished so that upon swelling in service the inside diameter 32 tends to stay fixed against the mandrel 24 with a sufficient net force to minimize if not eliminate leak paths between the mandrel 24 and the element 22. FIG. 5 shows that the element 22 can be placed over a tubular between sections of screen 29 and 31 so that it can act as an isolator between them. Either the pressure or vacuum technique previously described can be used for such placement. FIG. 6 shows placement of a swelling element 22 over a screen 33 using either the vacuum or internal pressure techniques described above. The element 22 can then be advanced to a particular spot to coincide, for example, with a zone of shale 35 between production zones 37 and 39. In that way, when element 22 swells, it will prevent the shale from entering the screen 33 while the producing zones 37 and 39 will flow through the screen 33.

A variety of known swelling materials can be used for the element 22 such as rubber.

In addition to swelling by the element 22 the mandrel 24 or underlying screen 33 could also be radially expanded using a variety of known expansion techniques.

The above description is illustrative of the preferred embodiment and many modifications may be made by those skilled in the art without departing from the invention whose scope is to be determined from the literal and equivalent scope of the claims below.

We claim:

1. A downhole packer, comprising:

a mandrel;

an element mounted to said mandrel and formed of a material that swells to seal downhole on contact with fluids in or added to a wellbore without axial compression, wherein said element has at least a portion that swells and that portion is initially mounted in contact with said mandrel in a manner that leaves a hoop stress in said portion that swells that is located adjacent said mandrel.

2. The packer of claim 1, wherein:

said hoop stress retains the inside diameter of said element to said mandrel after said swelling of said element.

3. The packer of claim 1, wherein:

the initial inside diameter of said element is no larger than the mandrel outside diameter.

4. The packer of claim 3, wherein:

said initial inside diameter of said element is smaller than the mandrel outside diameter.

5. The packer of claim 4, wherein:

said inside diameter of said element is increased to allow insertion of said mandrel though said element.

6. The packer of claim 5, wherein:

said element inside diameter is increased by vacuum applied to it.

7. The packer of claim 6, wherein:

said element has a sealing exterior surface to which said vacuum is applied.

8. The packer of claim 6, wherein:

said element is placed in a surrounding pipe with at least one opening through which a vacuum is applied to its outer sealing surface to temporarily increase said initial inside diameter of said element.

9. The packer of claim 5, wherein:

said initial inside diameter is increased with pressure applied to said initial inside diameter to allow insertion of said mandrel.

10. The packer of claim 5, wherein:

said inside diameter is allowed to be reduced after insertion of said mandrel to get contact between said element and said mandrel by removal of previously applied pressure.

11. The packer of claim 5, wherein:

said mandrel comprises a screen, at least in part.

12. The packer of claim 11, wherein:

said element covers an unperforated section adjacent a screen portion of said mandrel.

13. The packer of claim 12, wherein:

said element isolates one screen portion from another screen portion on said mandrel.

14. The packer of claim 1, wherein:

at least a portion of said hoop stress remains after the element swells.

15. The packer of claim 14, wherein:

said remaining hoop stress at least minimizes leak path formation after swelling. between said element and said mandrel.

16. The packer of claim 1, wherein:

said mandrel is either perforated or unperforated and comprises an inside dimension that can be forcibly enlarged downhole to increase the size of said element independently of said element swelling downhole

17. A downhole packer, comprising:

a mandrel;

an element mounted to said mandrel and formed of a material that swells to seal downhole on contact with fluids in or added to a wellbore without axial compression, wherein said element is initially mounted to said mandrel in a manner that leaves a hoop stress in said element adjacent said mandrel;

the initial inside diameter of said element is no larger than the mandrel outside diameter;

said initial inside diameter of said element is smaller than the mandrel outside diameter;

said inside diameter of said element is increased to allow insertion of said mandrel though said element;

said mandrel comprises a screen, at least in part;

said element covers a portion of said screen.

* * * * *